United States Patent [19]

Stoecker

[11] Patent Number: 4,637,642

[45] Date of Patent: Jan. 20, 1987

[54] STOWAGE BIN LATCH ASSEMBLY

[75] Inventor: Carl H. Stoecker, Seattle, Wash.

[73] Assignee: The Boeing Company, Seattle, Wash.

[21] Appl. No.: 592,019

[22] PCT Filed: Dec. 16, 1983

[86] PCT No.: PCT/US83/01998

§ 371 Date: Dec. 16, 1983

§ 102(e) Date: Dec. 16, 1983

[87] PCT Pub. No.: WO85/02645

PCT Pub. Date: Jun. 20, 1985

[51] Int. Cl.[4] ..... E05C 3/30

[52] U.S. Cl. ..... 292/129; 292/DIG. 37; 292/DIG. 62

[58] Field of Search ..... 292/109, 114, 129, 127, 292/229, 227, DIG. 37, DIG. 62, 126

[56] References Cited

U.S. PATENT DOCUMENTS

| | | | |
|---|---|---|---|
| 1,133,254 | 3/1915 | Backus | 292/127 |
| 1,158,412 | 10/1915 | Wheary | 292/DIG. 62 |
| 1,178,697 | 4/1916 | Yurow | 292/129 |
| 1,681,986 | 8/1928 | Lewis | 292/127 |
| 1,703,556 | 2/1929 | Stewart | 292/127 |
| 1,766,193 | 6/1930 | Schmitz et al. | 292/24 |
| 1,805,789 | 5/1931 | Stuart et al. | 292/127 |
| 2,074,449 | 3/1937 | Ziomek et al. | 292/45 |
| 2,219,132 | 10/1940 | Hohmann et al. | 292/45 |
| 2,572,129 | 10/1951 | Fuller | 292/45 |
| 2,596,003 | 5/1952 | Acocello | 292/127 |
| 3,087,749 | 4/1963 | Capton | 292/129 X |
| 3,596,952 | 8/1971 | Hinkle et al. | 292/27 |
| 4,208,837 | 6/1980 | Black, Sr. et al. | 292/229 X |

FOREIGN PATENT DOCUMENTS

| | | |
|---|---|---|
| 46540 | 3/1974 | Australia . |
| 622197 | 11/1935 | Fed. Rep. of Germany . |

*Primary Examiner*—Richard E. Moore

*Attorney, Agent, or Firm*—Hughes & Cassidy

[57] ABSTRACT

A latching assembly for a door of an overhead stowage bin for a passenger aircraft. There is a pivotally mounted latching arm which is moved by an actuating member having upper and lower contact members, with the lower contact member being spaced downwardly from the latching arm when in its latching position. The actuating member is urged downwardly by spring means to the latching position. The latch remains secured in its latching position even though impact loads may be imposed on the door.

13 Claims, 8 Drawing Figures

FIG. 7
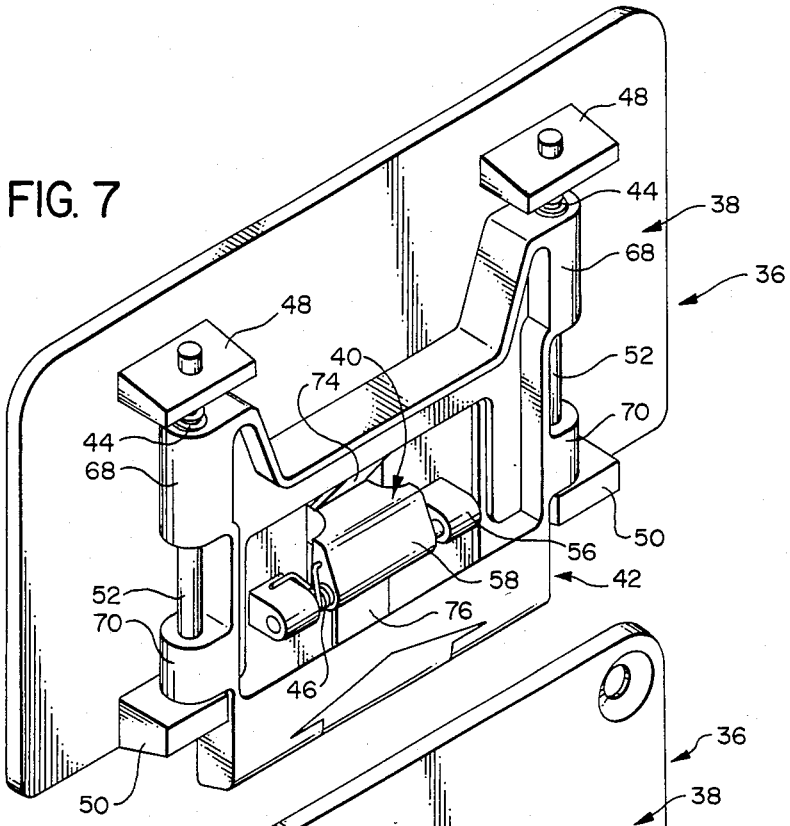
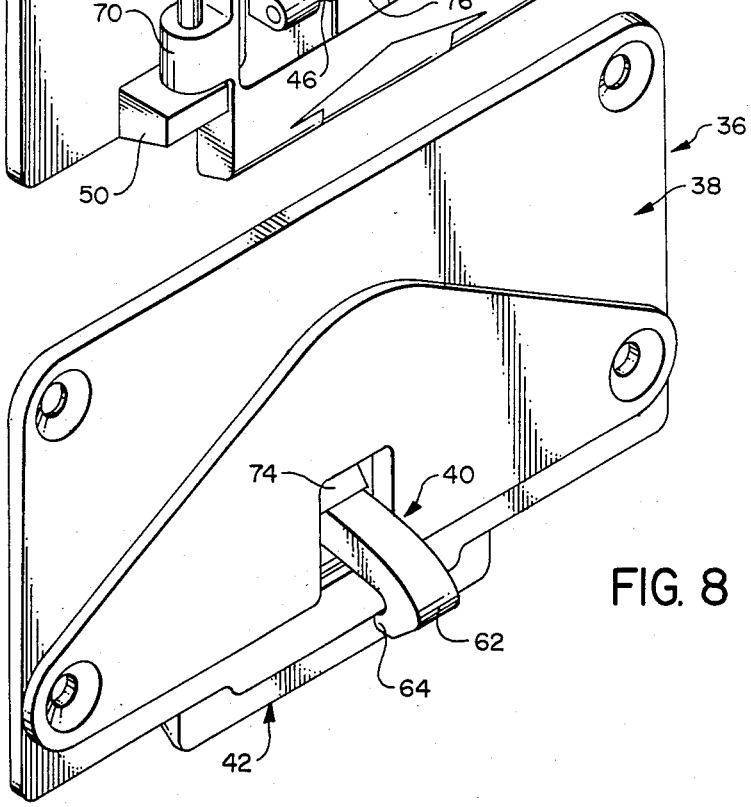
FIG. 8

STOWAGE BIN LATCH ASSEMBLY

TECHNICAL FIELD

The present invention relates to a latch assembly particularly adapted for use in closing the door of an overhead stowage bin of a passenger aircraft.

BACKGROUND ART

In designing the interior of the passenger section of an aircraft, there are a number of important cosiderations. One concern is, of course, the overall comfort, convenience, and safety provided for the passengers. Further, there is concern that the equipment be designed so that it is relatively simple and lightweight (minimizing weight being of particular concern to aircraft design), and yet be convenient to operate in a reliable manner.

In the present day design of commercial passenger aircraft, it is quite common to have stowage bins located above the passenger seats. Quite commonly, these stowage bins are closed by doors which are hinge mounted at their upper edge portions so that the doors swing upwardly and outwardly to an open position. It is also common for these doors to be spring loaded in a manner that they are urged with moderate force toward the upper opened position. In the closed position, these doors should be latched properly so that the stowed material is properly contained in the bin. The present invention is directed toward the latching assembly which holds the stowage bin doors in the closed position.

A search of the patent literature has disclosed a number of patents relating generally to latching assemblies, and these are discussed briefly below.

U.S. Pat. No. 1,681,986, Lewis, discloses a latch for a window where there is a handle member which can be used to unlock the sash and also be used as a means of raising the sash after it is unlocked. Lifting the handle causes a pivotally mounted latching member to move out of latching engagement.

U.S. Pat. No. 1,766,193, Schmitz, et al, shows a latching assembly for the door of a locker. There is an exterior handle which is attached to a vertically oriented channel member on which are pivotally mounted a number of latching hooks. Raising the handle lifts the channel so that the hooks are lifted out of locking engagement.

U.S. Pat. No. 2,074,449, Ziomek, et al, shows a locking mechanism by which the forward and rear doors of an automobile or other structure are latched. There are a pair of pivotally mounted locking members which can move into engagement with the two doors. There is a vertically movable actuating member which acts through links or arms which in turn move the locking members into and out of locking engagement.

U.S. Pat. No. 2,219,132, Hohmann, et al, illustrates an electric door lock where there are a pair of pivotally mounted locking members which rotate into and out of engagement with matching locking members.

U.S. Pat. No. 2,572,129, Fuller, shows a locking device for vehicle doors, this device being operable from the hand brake of the automobile. There are pivotally mounted locking members which are operated by a plunger 24 which acts against a pair of inclined shoulders to rotate the locking members into and out of locking engagement.

U.S. Pat. No. 3,596,952, Hinkle, et al, shows a latching assembly where there is a slide button which actuates a pair of bell cranks which in turn convert the linear motion of the slide button to rotary motion. This motion is transmitted through connecting rods to the latch to rotate the latch member into and out of locking engagement.

Also, as part of the prior art, it is noted that latching devices which are currently used for aircraft comprise an operating handle or member which is slide mounted for vertical motion, with a spring urging the operating member toward a downward latching position. There is a hook or latching member fixedly attached to the operating member, and lifting the operating member simply lifts the hook linearly out of locking engagement.

It is an object of the present invention to provide a latching assembly particularly adapted for use in an overhead stowage bin of an aircraft, but also adaptable for use in other applications, which reliably performs its latching and unlatching function of a relatively simple structure and is easily operated.

SUMMARY OF THE INVENTION

The latch assembly of the present invention is particularly adapted to latch a door, such as a door for a stowage bin, with the door having a front side and a rear side, a hinge end where the door is mounted for swing motion about a door hinge axis and a swing end opposite to the hinge end. The door has a reference plane which is coincident with the hinge axis and the swing end. The latch assembly is adapted to be mounted at the swing end of the door to latch the swing end to stationary structure.

The latch assembly comprises a base member adapted to be located at the swing end of the door. There is an actuating member mounted to the base member for substantially linear movement along an operating path generally parallel with the reference plane between a latching position and a release position. There is also a main spring means to urge the actuating member to its latching position.

There is a latching arm having a forwardly positioned pivot end by which the arm is pivotally mounted to the base member for rotation about a latching axis which is generally parallel with the door reference plane, and a rearwardly positioned latching end where the arm has a hook member extending laterally from the latching arm. The hook member has a forwardly facing latching surface adapted to engage a matching striker member mounted to stationary structure. The arm has a lengthwise axis extending from the pivot end of the arm to the latching surface. The arm is pivotally movable about said latching axis between a first latching position and a second release position.

The actuating member has arm contacting means positioned to engage the latching arm at an intermediate location between the pivot end and the latching end.

In the preferred embodiment, there is second spring means operatively connected to the latching arm to urge the latching arm toward its release position. More particularly, in the preferred form, the spring means comprises a coil spring mounted about the latching axis of the latching arm.

In the preferred form of the contacting means, it comprises a first contact member positioned to engage the latching arm to move the latching arm to its latching position and a second contact member to engage the latching arm to move the latching arm toward its release position. The second contact member is positioned so that with the actuating member at its latching location, the second contact member is positioned at a location spaced from the latching arm. Thus, limited movement of the actuating member toward its release position is possible, without tending to move the latching arm from its latching position.

Preferably, the actuating member is mounted to the base member for slide motion along the operating path. Also, in the preferred form, the latching assembly has a contact surface by which the actuating member can be manually engaged to be pushed toward its release position. The contact surface is slanted in a forward direction toward the hinge axis of the door, whereby a force exerted perpendicular to the contact surface tends to push the actuating member rearwardly, as well as along a path of movement toward its release position.

Also, in the preferred form, the latching surface of the hook member is positioned relative to the latching axis of the latching arm in a manner that a line drawn perpendicular to the latching surface toward the latching axis extends to a location spaced from the latching axis in a direction that the latching arm moves when moving toward its release position. Thus, rotation of the latching arm from its latching position has a rearward component of movement relative to the reference plane.

Other features of the present invention will become apparent from the following detailed description.

BRIEF DESCRIPTION OF THE DRAWINGS

FIG. 7 is an isometric view looking downwardly toward the forward side of the latch by itself; and FIG. 8 is a view similar to FIG. 7, but looking toward the back side of the latch.

DESCRIPTION OF THE PREFERRED EMBODIMENT

Figure 1:
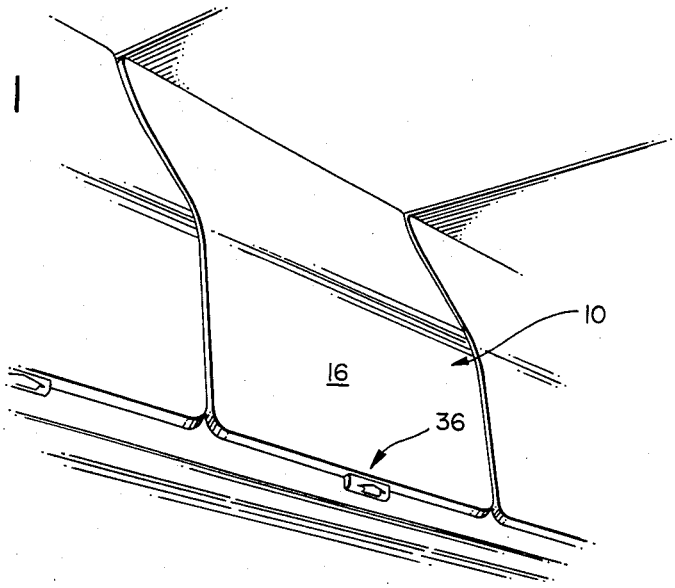
FIG. 1 is an isometric view of a stowage bin incorporating a latch of the present invention, with the door in its closed position.

The latching assembly of the present invention is particularly adapted for use with a door closing a stowage bin, such as an overhead stowage bin commonly used in present-day commercial passenger aircraft. Such a stowage bin is shown generally at 10, and it can be seen to comprise upper and lower walls 12 and 14. The bin 10 is closed by a door 16 which is hinge mounted at its upper edge portion along a hinge axis 18. It is quite common for such doors to be urged by a spring mechanism toward an upper open position, and such a spring mechanism is indicated somewhat schematically at 20. As shown herein, the mechanism 20 comprises an extendable spring member 22 having an internal spring mechanism which urges it toward its extended position. One end of the spring member is connected at 24 to stationary structure, and the opposite end is connected to the structure of the door 16 at a location 26 spaced moderately from the hinge axis 18.

In describing the present invention, the term "forward" will refer to the lateral direction in which the door 16 initially swings in moving from its closed to its open position. The term "rear" shall refer to a location further from the center longitudinal centerline of the airplane fuselage and closer to the more inaccessible portion of the bin 10 (i.e., that portion of the bin 10 which is further from the door 16). Thus, the door 16 can be described as having a forward surface 28 which is exposed when the door 16 is closed, and a rear surface 30 which is unexposed when the door 16 is closed.

Also, for purposes of description, the door 16 can be considered as occupying a reference plane, generally designated at 32, this reference plane being coincident with the hinge axis 18 and extending therefrom to the lower edge 34 of the door 16. The lower door edge 34 is the swing end of the door, which moves from a lower closed position of the door 16 (shown in FIG. 1) forwardly and then upwardly toward an open position of the door 16 (shown in FIG. 2).

The latching assembly 36 of the present invention is in the present embodiment mounted at the lower door edge 34 at approximately the center thereof. This latching assembly comprises three main components, namely a base plate 38, latching arm 40, and an actuating member 42. In addition, there are a pair of main springs 44 which urge the actuating member 42 downwardly towards its latching position, and there is a secondary spring 46 which urges the latching arm 40 upwardly into engagement with the actuating member 42.

To describe these components 38–36 in more detail, the base plate 38 has an overall rectangular configuration and is mounted by screws or other means against the rear surface 30 of the door 16 adjacent the lower edge 34 of the door 16. The base plate 38 has a pair of upper and lower mounting brackets 48 and 50 extending forwardly from the plate 38, and the brackets 48 and 50 being mounted on opposite sides of the centerline of the plate 38. There are two vertically aligned mounting rods 52, each mounted to a related pair of mounting brackets 48 and 50. The lower middle portion of the plate 38 is formed with a rectangular thru-opening 54 to accommodate the latching arm 40. On opposite sides of the thru-opening 54, there are a pair of mounting bosses 56 by which the latching arm 40 is pivotally mounted to the plate 38.

The latching arm 40 has a forwardly positioned pivot end 58 about which the arm 40 is pivotally mounted for rotation about a generally horizontal latching axis 60, which is parallel to the door reference plane 32. The arm 40 has a rear latching end 62 formed with a downwardly extending hook 64. This hook 64 has a forwardly facing latching or engaging surface 66 which extends downwardly at a moderate forward slant to provide for a more secure latching action.

The actuating member 42 has a pair of upper and lower mounting members 68 and 70, respectively, with the two right hand members 68 and 70 being slide mounted to the right hand rod 52, and the other two members 68 and 70 being slide mounted to the left hand rod 52. The aforementioned main springs 44 are mounted around the upper portions of the rods 52 in a manner to press downwardly from the upper brackets 48 against the mounting members 68 so as to urge the actuating member 42 downwardly.

The actuating member 42 is formed with a center cutout 72 to accomodate the positioning of the bosses 56 and the latching arm 40. The actuating member 42 has upper and lower centrally located contact members 74 and 76, respectively. The contact member 74 reaches downwardly from an upper middle portion of the actuating member 42 and has a downwardly and rearwardly slanted end portion 78 adapted to engage an upper surface 80 of the arm 40 at a location moderately forwardly of the mounting axis 60. The lower contact member 76 has an upwardly and rearwardly slanting end portion 82 adapted to engage a lower surface portion 84 of the arm 40.

When the actuating member 42 is in its down latching position, where the lower mounting members 70 engage the lower mounting bosses 50, the end portion 78 of the upper contact member 74 is in engagement with the upper surface 80 of the arm 40, and the upper end portion 82 of the lower contact member 76 is spaced downwardly a short distance from the lower surface 84 of the arm 40. Also, the secondary spring 46 acts on the arm 40 to tend to rotate it upwardly with moderate pressure against the end portion 78 of the upper contact member 74.

To mount the arm 40 to the plate 38, there is a rod 86 which extends between the mounting bosses 56, and the spring 46 has several turns around this rod 86, with end fingers of the spring 46 engaging the left hand boss 56 and the arm 40, respectively, to urge the arm 40 to rotate upwardly. Further, the rear mounting portion 58 of the arm 40 is made substantially wider than the rest of the arm so that it can be more securely mounted to the rod 86. Nylon thrust bearings can be provided around the rod 86 on opposite sides of the rear mounting portion 58 of the arm 40.

The lower surface 88 of the actuating member 42 is provided as a pressure surface which a person presses (usually with the ends of his or her fingers) to push the actuating member 42 upwardly. This surface 88 is sloped forwardly at a moderate upward slant so that when a force is applied perpendicular to the surface 88, there is both a rearward and upward force component.

The latch striker 90 is in the form of a circular rod which extends across an opening 92 formed in stationary bin structure 94 at the lower forward portion of the bin. This striker 90 is mounted for rotation about its longitudinal axis between two mounting bosses 96 which are in turn made integral with a strike plate 98 that is fixedly connected to the bin structure 94. The striker 90 is positioned to engage the surface 66 of the hook end 64 of the arm 40.

Figure 2:
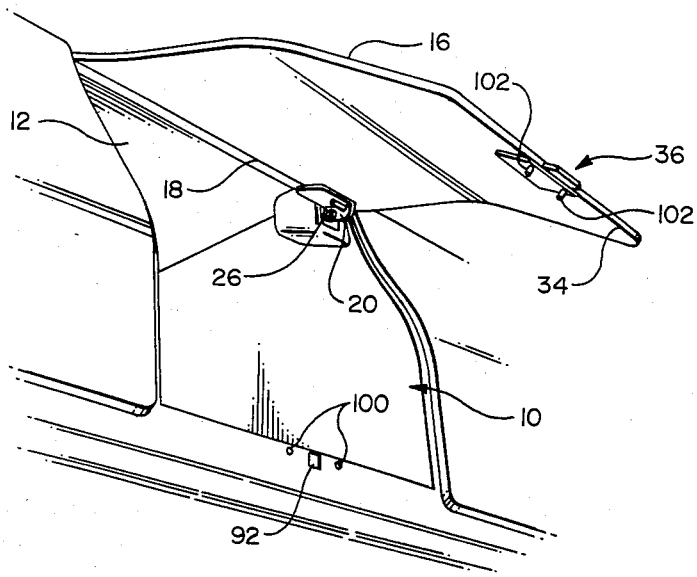
FIG. 2 is a view similar to FIG. 1, showing the door in the open position.

Also, as is shown in FIG. 2, there are shown as an optical feature a pair of locating sockets 100 mounted at the lower forward bin structure portion 94 on opposite sides of the opening 92. These two sockets or recesses 100 are positioned to receive a pair of matching locating pins 102 that are connected to the lower edge portion of the door 16 on opposite sides of the latching assembly 36.

Figure 3:
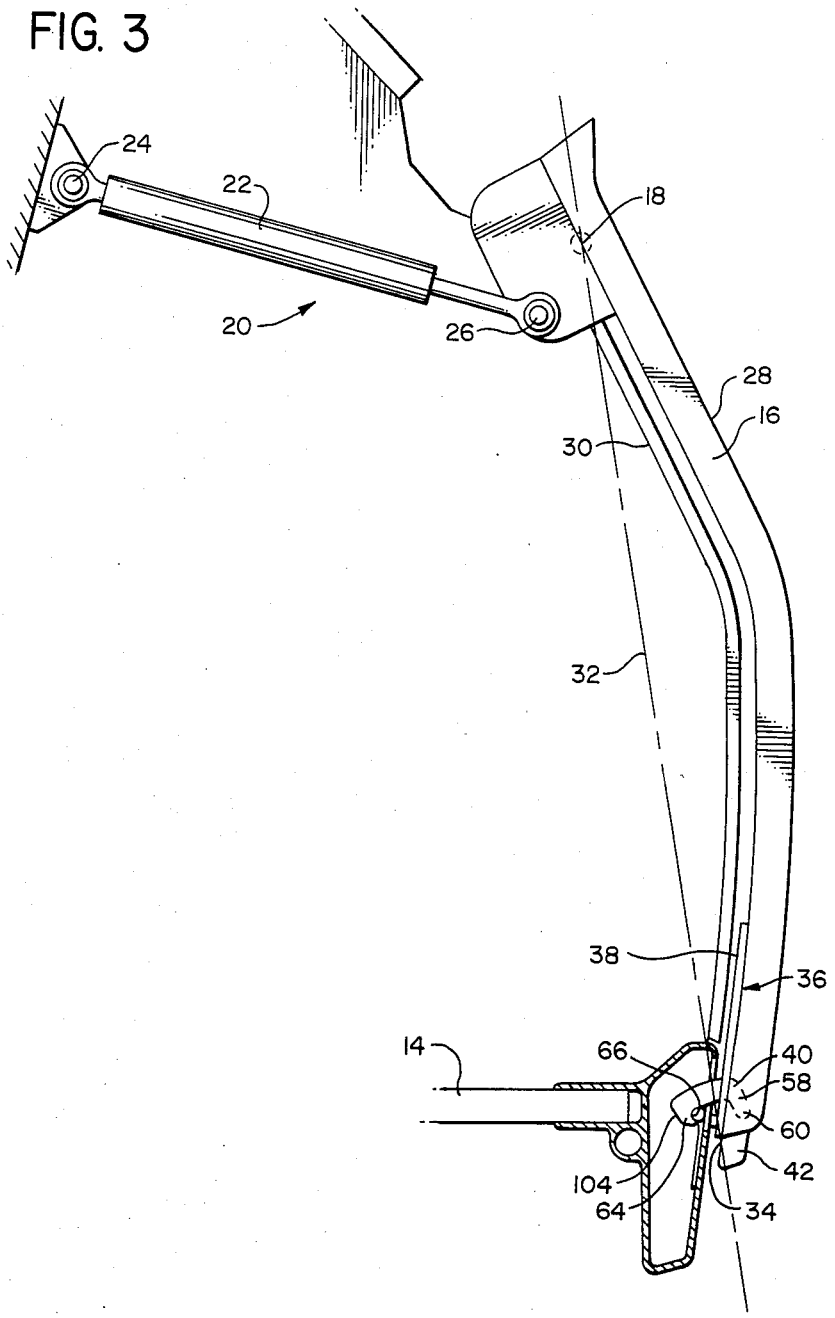
FIG. 3 is a sectional view taken perpendicular to the plane of the door and showing the door and the latching assembly in its latched position.
Figure 4:
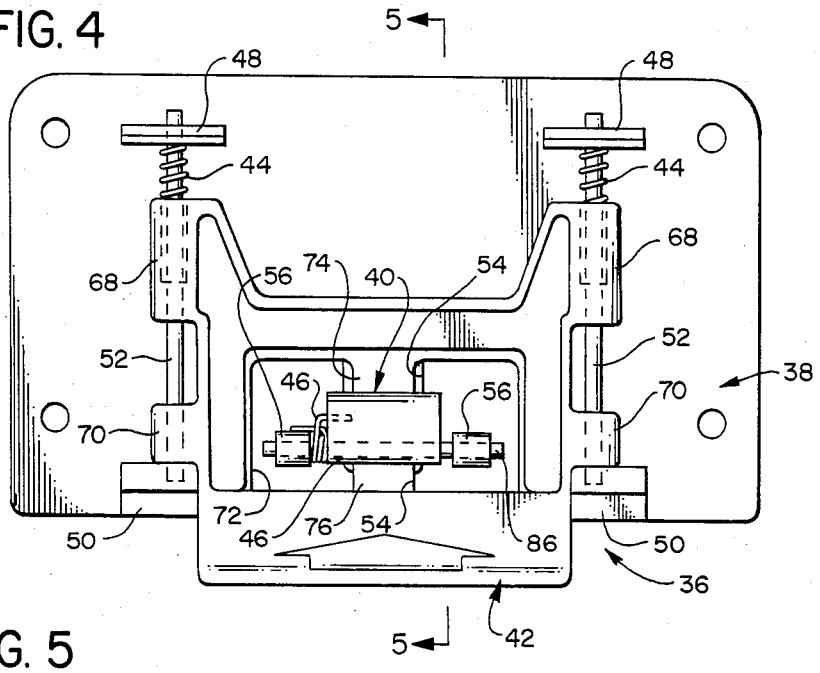
FIG. 4 is a plan view looking rearwardly toward the latch by itself.
Figure 5:
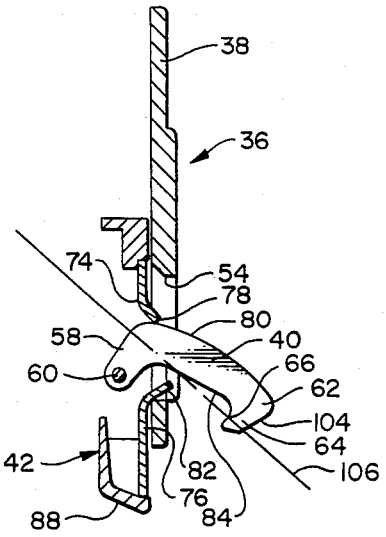
FIG. 5 is a sectional view taken along line 5—5 of FIG. 4.
Figure 6:
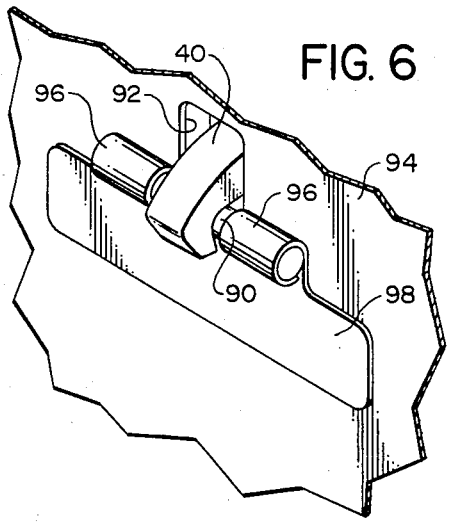
FIG. 6 is an isometric view illustrating the striker bar, engaged by the latching arm.

To describe the operation of the present invention, when the door 16 is swung downwardly to be closed, the arm 42 is positioned generally as shown in FIG. 3. When the door 16 has nearly reached its closed position, the lower forward surface 104 of the latching arm 40 engages the striker 90 to cause the amr 40 to rotate upwardly to a moderate extent to permit the hook 64 to travel over the striker 90 and then drop into its latching position, as shown in FIG. 3. The slope of the contact surface 66 is such that a line (such as drawn at 106) drawn perpendicular to the surface 66 in a forward and upward direction is a moderate distance above the axis of rotation 60. Thus, the surface 66 has what might be termed a "positive locking action", in that rotating the hook arm 40 out of hooking engagement requires a slight rearward movement of the arm 40 as it is rotated upwardly.

When the assembly 36 is in the latching position of FIG. 3, it has been found that any impact loads and the like have substantially no tendency to cause the arm 40 to unlatch. For example, if there is a sudden side load on the airplane in which the bin 10 is mounted, so that the contained baggage in the bin 10 would push outwardly against the door 16, the force exerted on the latching arm 40 is from the pivot axis 60 to the location of the striker 90. If there is any upward shifting of the door 16, for example because of the impact on the door 16 causing a moderate bend in the door 16, so that the lower edge portion 34 thereof might shift slightly upwardly, the mounting of the latching arm 40 is such that it could simply pivot downwardly toward the lower contact member 76 and still remain in secure latching engagement with the striker 90. Further, with the lower contact member 76 being spaced moderately below the arm 40 in its latched position, a small upward movement of the actuating member 42 would not tend to cause the arm 40 to move upwardly and unlatch.

On the other hand, even though the latch assembly 36 is quite secure in its latched position, it can very easily be moved to the release position. The slope of the surface 88 is such that the normal force applied by the person's hand would be in an upward and rearward direction. This would tend to cause the door 16 to yield moderately in a rearward direction, thus giving the rather small amount of rearward movement of the latching arm 40 that would be required to permit it to disengage easily from the striker 90.

It is obvious that various changes could be made in the present invention without departing from the basic teachings thereof.

I claim:

1. A latch assembly particularly adapted to latch a door, such as a door for a stowage bin where the door has a forward side and a rear side, an upper hinge end about which the door is mounted for swing motion about a door hinge axis and a lower swing end opposite to the hinge end, where said door has a closed position at which said door is substantially vertically aligned and is movable in a forward and upward direction to an open position, and where said door has a generally vertical door reference plane which, with the door in its closed position, is coincident with said hinge axis and said swing end, said latch assembly adapted to be mounted at the swing end of the door to latch the swing end to stationary structure, said latch assembly comprising:

a. a base member which has a latch reference plane and which is adapted to be located at and mounted to the swing end of the door in a manner that the latch reference plane is generally parallel to the door reference plane;

b. an actuating member mounted to the base member for substantially linear movement along a generally vertical operating path generally parallel with said latch reference plane between a lower latching position and an upper release position, said actuating member having a through opening, and upper and lower contact members located at upper and lower sides, respectively of said through opening;

c. a first main spring means to urge said actuating member downwardly to its latching position;

d. a latching arm having a forward pivot end by which the arm is pivotally mounted to the base member for rotation about a latching axis which is generally parallel with the latch reference plane and located forwardly of the through opening of the actuating member, and a rear latching end where the arm has a hook member extending laterally from the latching arm and having a forwardly facing latching surface adapted to engage a matching striker member, said latching end being located rearwardly of the through opening of the latching member, said arm extending through said through opening and having a lengthwise axis extending from the pivot end of the arm to the latching surface, said arm being pivotally movable about said latching axis between a first lower latching position and a second upper release position;

e. said actuating member being arranged in a manner that upward movement of the actuating member causes the lower contact member to engage the latching arm at an intermediate location between the pivot end and the latching end to move the arm to said second release position, and downward movement of said actuating member causes the upper contact member to engage the latching arm at said intermediate location to move the arm to said first latching position; and f. a second spring means operatively connected between said base member and said latching arm to urge the latching arm toward its release position.

2. The latch assembly as recited in claim 1, wherein said second spring means comprises a coil spring mounted about the latching axis of the latching arm, with one end of the spring engaging the latching arm and a second end of the spring engaging the base member.

3. The latch assembly as recited in claim 1, said lower contact member being positioned so that with the actuating member at its latching location, said lower contact member is positioned at a location spaced downwardly from said latching arm, whereby limited movement of said actuating member upwardly toward its release position is possible, without tending to move said latching arm from its latching position.

4. A latch assembly particularly adapted to latch a door, such as a door for a stowage bin where the door has a forward side and a rear side, an upper hinge end about which the door is mounted for swing motion about a door hinge axis and a lower swing end opposite to the hinge end, where said door has a closed position at which said door is substantially vertically aligned and is movable in a forward and upward direction to an open position, and where said door has a generally vertical door reference plane which, with the door in its closed position, is coincident with said hinge axis and said swing end, said latch assembly adapted to be mounted at the swing end of the door to latch the swing end to stationary structure, said latch assembly comprising:

a. a base member which has a latch reference plane and which is adapted to be located at and mounted to the swing end of the door in a manner that the latch reference plane is generally parallel to the door reference plane;

b. an actuating member mounted to the base member for substantially linear movement along a generally vertical operating path generally parallel with said latch reference plane between a lower latching position and an upper release position, said actuating member having a through opening, and upper and lower contact members located at upper and lower sides, respectively of said through opening;

c. a first main spring means to urge said actuating member downwardly to its latching position;

d. a latching arm having a forward pivot end by which the arm is pivotally mounted to the base member for rotation about a latching axis which is generally parallel with the latch reference plane and located forwardly of the through opening of the actuating member, and a rear latching end where the arm has a hook member extending laterally from the latching arm and having a forwardly facing latching surface adapted to engage a matching striker member, said latching end being located rearwardly of the through opening of the latching member, said arm extending through said through opening and having a lengthwise axis extending from the pivot end of the arm to the latching surface, said arm being pivotally movable about said latching axis between a first lower latching position and a second upper release position;

e. said actuating member being arranged in a manner that upward movement of the actuating member causes the lower contact member to engage the latching arm at an intermediate location between the pivot end and the latching end to move the arm to said second release position, and downward movement of said actuating member causes the upper contact member to engage the latching arm at said intermediate location to move the arm to said first latching position; and f. said lower contact member being positioned so that with the actuating member at its latching location, said lower contact member is positioned at a location spaced from said latching arm, whereby limited movement of said actuating member toward its release position is possible, without tending to move said latching arm from its latching position.

5. A latch assembly particularly adapted to latch a door, such as a door for a stowage bin where the door has a forward side and a rear side, an upper hinge end about which the door is mounted for swing motion about a door hinge axis and a lower swing end opposite to the hinge end, where said door has a closed position at which said door is substantially vertically aligned and is movable in a forward and upward direction to an open position, and where said door has a generally vertical door reference plane which, with the door in its closed position, is coincident with said hinge axis and said swing end, said latch assembly adapted to be mounted at the swing end of the door to latch the swing end to stationary structure, said latch assembly comprising:

a. a base member which has a latch reference plane and which is adapted to be located at and mounted to the swing end of the door in a manner that the latch reference plane is generally parallel to the door reference plane;

b. an actuating member mounted to the base member for substantially linear movement along a generally vertical operating path generally parallel with said latch reference plane between a lower latching position and an upper release position, said actuating member having a through opening, and upper and lower contact members located at upper and lower sides, respectively of said through opening;

c. a first main spring means to urge said actuating member downwardly to its latching position;

d. a latching arm having a forward pivot end by which the arm is pivotally mounted to the base member for rotation about a latching axis which is generally parallel with the latch reference plane and located forwardly of the through opening of the actuating member, and a rear latching end where the arm has a hook member extending laterally from the latching arm and having a forwardly facing latching surface adapted to engage a matching striker member, said latching end being located rearwardly of the through opening of the latching member, said arm extending through said through opening and having a lengthwise axis extending from the pivot end of the arm to the latching surface, said arm being pivotally movable about said latching axis between a first lower latching position and a second upper release position;

e. said actuating member beng arranged in a manner that upward movement of the actuating member causes the lower contact member to engage the latching arm at an intermediate location between the pivot end and the latching end to move the arm to said second release position, and downward movement of said actuating member causes the upper contact member to engage the latching arm at said intermediate location to move the arm to said first latching position; and f. said actuating member being mounted to said base member for slide motion along said operating path.

6. The latch assembly as recited in claim 5, wherein said latching assembly has a downwardly facing contact surface by which said actuating member can be manually engaged to be pushed toward its release location, said contact surface being slanted in an upward and forward direction, whereby a force exerted perpendicular to said contact surface tends to push said actuating member rearwardly, as well as along an upward path of movement toward its release position.

7. A latch assembly particularly adapted to latch a door, such as a door for a stowage bin where the door has a forward side and a rear side, an upper hinge end about which the door is mounted for swing motion about a door hinge axis and a lower swing end opposite to the hinge end, where said door has a closed position at which said door is substantially vertically aligned and is movable in a forward and upward direction to an open position, and where said door has a generally vertical door reference plane which, with the door in its closed position, is coincident with said hinge axis and said swing end, said latch assembly adapted to be mounted at the swing end of the door to latch the swing end to stationary structure, said latch assembly comprising:

a. a base member which has a latch reference plane and which is adapted to be located at and mounted to the swing end of the door in a manner that the latch reference plane is generally parallel to the door reference plane;

b. an actuating member mounted to the base member for substantially linear movement along a generally vertical operating path generally parallel with said latch reference plane between a lower latching position and an upper release position, said actuating member having a through opening, and upper and lower contact members located at upper sides, respectively of said through opening;

c. a first main spring means to urge said actuating member downwardly to its latching position;

d. a latching arm having a forward pivot end by which the arm is pivotally mounted to the base member for rotation about a latching axis which is generally parallel with the latch reference plane and located forwardly of the through opening of the actuating member, and a rear latching end where the arm has a hook member extending laterally from the latching arm and having a forwardly facing latching surface adapted to engage a matching striker member, said latching end being located rearwardly of the through opening of the latching member, said arm extending through said through opening and having a lengthwise axis extending from the pivot end of the arm to the latching surface, said arm being pivotally movable about said latching axis between a first lower latching position and a second upper release position;

e. said actuating member being arranged in a manner that upward movement of the actuating member causes the lower contact member to engage the latching arm at an intermediate location between the pivot end and the latching end to move the arm to said second release position, and downward movement of said actuating member causes the upper contact member to engage the latching arm at said intermediate location to move the arm to said first latching position; and f. said actuating member having a downwardly facing contact surface by which said actuating member can be manually engaged to be pushed toward its release location, said contact surface being slanted in an upward and forward direction, whereby a force exerted perpendicular to said contact surface tends to push said actuating member rearwardly, as well as along an upward path of movement toward its release position.

8. A latch assembly particularly adapted to latch a door, such as a door for a stowage bin where the door has a forward side and a rear side, an upper hinge end about which the door is mounted for swing motion about a door hinge axis and a lower swing end opposite to the hinge end, where said door has a closed position at which said door is substantially vertically aligned and is movable in a forward and upward direction to an open position, and where said door has a generally vertical door reference plane which, with the door in its closed position, is coincident with said hinge axis and said swing end, said latch assembly adapted to be mounted at the swing end of the door to latch the swing end to stationary structure, said latch assembly comprising:

a. a base member which has a latch reference plane and which is adapted to be located at and mounted to the swing end of the door in a manner that the latch reference plane is generally parallel to the door reference plane;

b. an actuating member mounted to the base member for substantially linear movement along a generally vertical operating path generally parallel with said latch reference plane between a lower latching position and an upper release position, said actuating member having a through opening, and upper and lower contact members located at upper and lower sides, respectively of said through opening;

c. a first main spring means to urge said actuating member downwardly to its latching position;

d. a latching arm having a forward pivot end by which the arm is pivotally mounted to the base member for rotation about a latching axis which is generally parallel with the latch reference plane and located forwardly of the through opening of the actuating member, and a rear latching end where the arm has a hook member extending laterally from the latching arm and having a forwardly facing latching surface adapted to engage a matching striker member, said latching end being located rearwardly of the through opening of the latching member, said arm extending through said through opening and having a lengthwise axis extending from the pivot end of the arm to the latching surface, said arm being pivotally movable about said latching axis between a first lower latching position and a second upper release position;

e. said actuating member being arranged in a manner that upward movement of the actuating member causes the lower contact member to engage the latching arm at an intermediate location between the pivot end and the latching end to move the arm to said second release position, and downward movement of said actuating member causes the upper contact member to engage the latching arm at said intermediate location to move the arm to said first latching position; and f. the latching surface of the hook member being positioned relative to the latching axis of the latching arm, whereby a line drawn perpendicular to the latching surface toward the latching axis extends to a location spaced upwardly from the latching axis in a direction that the latching arm moves when moving toward its release position.

9. A latch assembly particularly adapted to latch a door, such as a door for a stowage bin where the door has a forward side and a rear side, an upper hinge end about which the door is mounted for swing motion about a door hinge axis and a lower swing end opposite to the hinge end, where said door has a closed position at which said door is substantially vertically aligned and is movable in a forward and upward direction to an open position, and where said door has a generally vertical door reference plane which, with the door in its closed position, is coincident with said hinge axis and said swing end, said latch assembly adapted to be mounted at the swing end of the door to latch the swing end to stationary structure, said latch assembly comprising:

a. a base member which has a latch reference plane and which is adapted to be located at and mounted to the swing end of the door in a manner that the latch reference plane is generally parallel to the door reference plane;

b. an actuating member mounted to the base member for substantially linear movement along a generally vertical operating path generally parallel with said latch reference plane between a lower latching position and an upper release position, said actuating member having a through opening, and upper and lower contact members located at upper and lower sides, respectively of said through opening;

c. a first main spring means to urge said actuating member downwardly to its latching position;

d. a latching arm having a forward pivot end by which the arm is pivotally mounted to the base member for rotation about a latching axis which is generally parallel with the latch reference plane and located forwardly of the through opening of the actuating member, and a rear latching end where the arm has a hook member extending laterally from the latching arm and having a forwardly facing latching surface adapted to engage a matching striker member, said latching end being located rearwardly of the through opening of the latching member, said arm extending through said through opening and having a lengthwise axis extending from the pivot end of the arm to the latching surface, said arm being pivotally movable about said latching axis between a first lower latching position and a second upper release position;

e. said actuating member being arranged in a manner that upward movement of the actuating member causes the lower contact member to engage the latching arm at an intermediate location between the pivot end and the latching end to move the arm to said second release position, and downward movement of said actuating member causes the upper contact member to engage the latching arm at said intermediate location to move the arm to said first latching position;

f. a second spring means operatively connected between said base member and said latching arm to urge the latching arm toward its release position;

g. said lower contact member being positioned so that with the actuating member at its latching location, said lower contact member is positioned at a location spaced downwardly from said latching arm, whereby limited movement of said actuating member upwardly toward its release position is possible, without tending to move said latching arm from its latching position;

h. said actuating member being mounted to said base member for slide motion along said operating path; and i. the latching surface of the hook member being positioned relative to the latching axis of the latching arm, whereby a line drawn perpendicular to the latching surface toward the latching axis extends to a location spaced upwardly from the latching axis in a direction that the latching arm moves when moving toward its release position.

10. The latch assembly as recited in claim 9, wherein said latching assembly has a downwardly facing contact surface by which said actuating member can be manually engaged to be pushed toward its release location, said contact surface being slanted in an upward and forward direction, whereby a force exerted perpendicular to said contact surface tends to push said actuating member rearwardly, as well as along an upward path of movement toward its release position.

11. A combined latch and door structure, comprising:

a. a door having a forward side and a rear side, an upper hinge end about which the door is mounted for swing motion about a door hinge axis and a lower swing end opposite to the hinge end, said door having a closed position where said door is substantially vertically aligned and being movable in a forward and upward direction to an open position, said door having a generally vertical reference plane which, with the door in its closed position, is coincident with said hinge axis and said swing end;

b. a latch assembly adapted to be mounted at the swing end of the door to latch the swing end to stationary structure, said latch assembly comprising:

1. a base member located at and mounted to the swing end of the door;
2. an actuating member mounted to the base member for substantially linear movement along a generally vertical operating path generally parallel with said reference plane between a lower latching position and an upper release position, said actuating member having a through opening, and upper and lower contact members located at upper and lower sides, respectively of said through opening;
3. a first main spring means to urge said actuating member downwardly to its latching position;
4. a latching arm having a forward pivot end by which the arm is pivotally mounted to the base member for rotation about a latching axis which is generally parallel with the door reference plane and located forwardly of the through opening of the actuating member, and a rear latching end where the arm has a hook member extending laterally from the latching arm and having a forwardly facing latching surface adapted to engage a matching striker member mounted to stationary structure, said latching end being located rearwardly of the through opening of the latching member, said arm extending through said through opening and having a lengthwise axis extending from the pivot end of the arm to the latching surface, said arm being pivotally movable about said latching axis between a first lower latching position and a second upper release position;
5. said actuating member being arranged in a manner that upward movement of the actuating member causes the lower contact member to engage the latching arm at an intermediate location between the pivot end and the latching end to move the arm to said release position, and downward movement of said actuating member causes the upper contact member to engage the latching arm at said intermediate location to move the arm to said latching position; and
6. a second spring means operatively connected between said base member and said latching arm to urge the latching arm toward its release position.

12. The latch and door structure as recited in claim 11, wherein said second spring means comprises a coil spring mounted about the latching axis of the latching arm, with one end of the spring engaging the latching arm and a second end of the spring engaging the base member.

13. The latch and door structure as recited in claim 11, said lower contact member being positioned so that with the actuating member at its latching location, said lower contact member is positioned at a location spaced downwardly from said latching arm, whereby limited movement of said actuating member upwardly toward its release position is possible, without tending to move said latching arm from its latching position.

* * * * *